US009903354B2

(12) United States Patent
Yamamoto et al.

(10) Patent No.: US 9,903,354 B2
(45) Date of Patent: Feb. 27, 2018

(54) VARIABLE DISPLACEMENT SWASH PLATE COMPRESSOR

(71) Applicant: KABUSHIKI KAISHA TOYOTA JIDOSHOKKI, Aichi-ken (JP)

(72) Inventors: Shinya Yamamoto, Kariya (JP); Takahiro Suzuki, Kariya (JP); Kazunari Honda, Kariya (JP); Kei Nishii, Kariya (JP); Yusuke Yamazaki, Kariya (JP); Masaki Ota, Kariya (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 261 days.

(21) Appl. No.: 14/666,860

(22) Filed: Mar. 24, 2015

(65) Prior Publication Data

US 2015/0275880 A1 Oct. 1, 2015

(30) Foreign Application Priority Data

Mar. 28, 2014 (JP) ..... 2014-070168

(51) Int. Cl.
*F04B 27/20* (2006.01)
*F04B 27/08* (2006.01)
(Continued)

(52) U.S. Cl.
CPC ..... *F04B 27/1804* (2013.01); *F04B 27/0804* (2013.01); *F04B 27/1036* (2013.01);
(Continued)

(58) Field of Classification Search
None
See application file for complete search history.

(56) References Cited

U.S. PATENT DOCUMENTS 4,037,993 A 7/1977 Roberts
4,061,443 A 12/1977 Black et al.
(Continued)

FOREIGN PATENT DOCUMENTS

CN 103807132 5/2014
CN 103807134 5/2014
(Continued)

OTHER PUBLICATIONS

U.S. Appl. No. 14/666,846 to Kazunari Honda et al., filed Mar. 24, 2015.
(Continued)

*Primary Examiner* — Peter J Bertheaud
*Assistant Examiner* — Geoffrey Lee
(74) *Attorney, Agent, or Firm* — Greenblum & Berstein, P.L.C.

(57) ABSTRACT

An actuator of a compressor includes a partitioning body, which is rotatable integrally with a drive shaft and loosely fitted to the drive shaft in the swash plate chamber, a movable body, which is coupled to a swash plate and movable relative to the partitioning body along the axis of the drive shaft, and a control pressure chamber, the pressure of which moves the movable body. A control mechanism changes the pressure of the control pressure chamber to move the movable body. A link mechanism shifts a top dead center of a first head of a piston over a longer distance than a top dead center of a second head of the piston when the inclination angle of the swash plate changes. The actuator is located at the same side as the first cylinder bore, which accommodates the first head, as viewed from the swash plate.

3 Claims, 4 Drawing Sheets

(51) Int. Cl.

| | |
|---|---|
| ***F04B 27/18*** | (2006.01) |
| ***F04B 27/10*** | (2006.01) |
| ***F04B 39/12*** | (2006.01) |

(52) U.S. Cl.
CPC ..... *F04B 27/1054* (2013.01); *F04B 27/1063* (2013.01); *F04B 27/1072* (2013.01); *F04B 27/20* (2013.01); *F04B 39/123* (2013.01)

(56) References Cited

U.S. PATENT DOCUMENTS

| | | | | |
|---|---|---|---|---|
| 4,174,191 | A | 11/1979 | Roberts | |
| 4,606,705 | A | 8/1986 | Parekh | |
| 4,884,952 | A | 12/1989 | Kanamaru et al. | |
| 4,946,350 | A | 8/1990 | Suzuki et al. | |
| 4,963,074 | A | 10/1990 | Sanuki et al. | |
| 5,032,060 | A * | 7/1991 | Kobayashi | F04B 27/12 417/222.1 |
| 5,186,475 | A | 2/1993 | Kawai et al. | |
| 5,259,736 | A | 11/1993 | Terauchi | |
| 5,370,503 | A | 12/1994 | Terauchi | |
| 5,636,973 | A | 6/1997 | Sonobe et al. | |
| 5,871,337 | A | 2/1999 | Fukanuma et al. | |
| 6,077,047 | A * | 6/2000 | Nagai | F04B 27/1072 417/222.1 |
| 6,126,405 | A | 10/2000 | Kawaguchi et al. | |
| 6,135,722 | A | 10/2000 | Kawaguchi et al. | |
| 6,139,282 | A | 10/2000 | Ota et al. | |
| 6,149,398 | A | 11/2000 | Fukanuma et al. | |
| 6,158,968 | A | 12/2000 | Nakamura | |
| 6,227,812 | B1 | 5/2001 | Kawaguchi et al. | |
| 6,250,891 | B1 | 6/2001 | Kawaguchi et al. | |
| 6,379,120 | B1 | 4/2002 | Adaniya et al. | |
| 6,520,751 | B2 | 2/2003 | Fujita et al. | |
| 6,546,742 | B1 | 4/2003 | Ota et al. | |
| 6,848,262 | B2 | 2/2005 | Nosaka | |
| 6,957,604 | B1 | 10/2005 | Tiedemann et al. | |
| 7,530,797 | B2 | 5/2009 | Ito et al. | |
| 7,841,839 | B2 | 11/2010 | Inoue et al. | |
| 8,596,994 | B2 | 12/2013 | Taguchi | |
| 9,228,576 | B2 | 1/2016 | Yamamoto et al. | |
| 9,228,577 | B2 | 1/2016 | Yamamoto et al. | |
| 9,309,874 | B2 | 4/2016 | Yamamoto et al. | |
| 9,309,875 | B2 | 4/2016 | Yamamoto et al. | |
| 9,316,217 | B2 | 4/2016 | Yamamoto et al. | |
| 9,429,147 | B2 | 8/2016 | Suzuki et al. | |
| 9,506,459 | B2 | 11/2016 | Ota et al. | |
| 2002/0006339 | A1 | 1/2002 | Ota et al. | |
| 2003/0223887 | A1 | 12/2003 | Kawano et al. | |
| 2004/0062660 | A1 | 4/2004 | Kazahaya et al. | |
| 2009/0107327 | A1 | 4/2009 | Ota et al. | |
| 2014/0127042 | A1 | 5/2014 | Yamamoto et al. | |
| 2014/0127045 | A1 | 5/2014 | Yamamoto et al. | |
| 2014/0294613 | A1 | 10/2014 | Suzuki et al. | |
| 2014/0294614 | A1 | 10/2014 | Ota et al. | |
| 2015/0285234 | A1 | 10/2015 | Nakaima et al. | |

FOREIGN PATENT DOCUMENTS

| | | |
|---|---|---|
| EP | 2728186 | 5/2014 |
| EP | 2784316 | 10/2014 |
| JP | 52-131204 | 11/1977 |
| JP | 62-225782 | 10/1987 |
| JP | 62-247184 | 10/1987 |
| JP | 2-19665 | 1/1990 |
| JP | 5-172052 | 7/1993 |
| JP | 10-246181 | 9/1998 |
| JP | 4378190 | 12/2009 |
| KR | 10-1992-0021904 | 12/1992 |
| WO | 2014/069618 | 5/2014 |

OTHER PUBLICATIONS

U.S. Appl. No. 14/666,759 to Shinya Yamamoto et al., filed Mar. 24, 2015.
U.S. Appl. No. 14/666,819 to Shinya Yamamoto et al., filed Mar. 24, 2015.
U.S. Appl. No. 14/666,639 to Shinya Yamamoto et al., filed Mar. 24, 2015.
U.S. Appl. No. 14/666,688 to Shinya Yamamoto et al., filed Mar. 24, 2015.
Official Action, along with English-language translation thereof, for CN Appl. No. 201510133584.4 dated Aug. 2, 2016.
Official Action, along with English-language translation thereof, for CN Appl. No. 201510133583 dated Aug. 17, 2016.
Official Action for CN Appl. No. 201510134293.7 dated Aug. 17, 2016.
Official Action in KR Appl. No. 10-2015-0040798 dated Nov. 21, 2016.
Official Action in KR Appl. No. 10-2015-0040736 dated Nov. 21, 2016.
Official Action in KR Appl. No. 10-2015-0040836 dated Nov. 24, 2016.
Official Action in KR Appl. No. 10-2015-0040839 dated Nov. 29, 2016.
Official Action issued in U.S. Appl. No. 14/666,688 dated Jan. 27, 2017.
Official Action issued in U.S. Appl. No. 14/666,846 dated Feb. 6, 2017.
Official Action issued in U.S. Appl. No. 14/666,819 dated Mar. 24, 2017.
Official Action issued in U.S. Appl. No. 14/666,639 dated Apr. 6, 2017.
Official Action issued in U.S. Appl. No. 14/666,759 dated Apr. 18, 2017.
Extended European Search Report for EP App. No. 15160831.2 dated Nov. 13, 2015.
Extended European Search Report for EP App. No. 15160830.4 dated Nov. 13, 2015.
Extended European Search Report for EP App. No. 15160833.8 dated Nov. 13, 2015.
Search Report for EP Pat. App. No. 15160832.0 dated Nov. 13, 2015.

* cited by examiner

VARIABLE DISPLACEMENT SWASH PLATE COMPRESSOR

BACKGROUND OF THE INVENTION

The present invention relates to a variable displacement swash plate compressor.

Japanese Laid-Out Patent Publication Nos. 2-19665 and 5-172052 describe conventional variable displacement swash plate compressors (hereafter simply referred to as the compressors). The compressors each have a housing including a suction chamber, a discharge chamber, a swash plate chamber, and pairs of cylinder bores. A rotatable drive shaft is supported in the housing. A swash plate that is rotatable together with the drive shaft is arranged in the swash plate chamber. A link mechanism is located between the drive shaft and the swash plate to allow the inclination angle of the swash plate to change. The inclination angle refers to an angle relative to a direction orthogonal to the rotation axis of the drive shaft.

Each cylinder bore pair accommodates a piston. The piston is reciprocated in the cylinder bore pair and defines compression chambers in the cylinder bore pair. Each cylinder bore pair includes a first cylinder bore, which is located at a first side, or front side, of the swash plate, and a second cylinder bore, which is located at a second side, or rear side, of the swash plate. Each piston includes a first head, which reciprocates in the first cylinder bore, and a second head, which is formed integrally with the first head and which reciprocates in the second cylinder bore.

A conversion mechanism coverts rotation of the swash plate to reciprocation of the piston in each cylinder bore pair. The stroke when the piston reciprocates is in accordance with the inclination angle of the swash plate. The inclination angle of the swash plate is changed by an actuator, which is controlled by a control mechanism.

The compressors described in Japanese Laid-Out Patent Publication Nos. 2-19665 and 5-172052 each include a pressure regulation chamber in a rear housing member, which is an element of the housing. A cylinder block, which is also an element of the housing, includes a control pressure chamber, which is in communication with the pressure regulation chamber. The actuator is located in the control pressure chamber. The actuator is not rotated integrally with the drive shaft.

In the same manner as each second cylinder bore and each second head, the actuator is located at the second side, or rear of the housing. The actuator includes a non-rotation movable body that covers the rear end of the drive shaft. The non-rotation movable body includes an inner wall surface that supports the rear end of the drive shaft so that the rear end is rotatable. The non-rotation movable body is movable along the rotation axis of the drive shaft. Although the non-rotation movable body moves in the control pressure chamber along the rotation axis of the drive shaft, the non-rotation movable body is not allowed to rotate about the rotation axis of the drive shaft. A spring that urges the non-rotation movable body toward the front is arranged in the control pressure chamber or the pressure regulation chamber. The actuator includes a movable body, which is coupled to the swash plate and movable along the rotation axis of the drive shaft. A thrust bearing is arranged between the non-rotation movable body and the movable body. A pressure control valve, which changes the pressure of the control chamber, is arranged between the pressure regulation chamber and the discharge chamber. A change in the pressure of the control pressure chamber moves the non-rotation movable body and the movable body in the axial direction of the drive shaft.

A link mechanism, which is located in the swash plate chamber, includes a movable body and a lug arm, which is fixed to the drive shaft. The rear end of the lug arm includes an elongated hole, which extends in a direction orthogonal to the rotation axis of the drive shaft and in a direction intersecting the rotation axis of the drive shaft. The front of the swash plate is supported by a pin inserted through the elongated hole so that the swash plate is pivotal about a first pivot axis.

In the compressor of Japanese Laid-Open Patent Publication No. 5-172052, the front end of the movable body also includes an elongated hole that extends in a direction orthogonal to the rotation axis and in a direction intersecting the rotation axis. The rear end of the swash plate is supported by a pin inserted through the elongated hole so that the swash plate is pivotal about a second pivot axis, which is parallel to the first pivot axis.

In each of these compressors, the pressure control valve opens to connect the discharge chamber and the pressure regulation chamber so that the pressure of the control pressure chamber becomes higher than that of the swash plate chamber. This moves the non-rotation movable body and the movable body toward the front. Thus, the inclination angle of the swash plate increases, the piston stroke is lengthened, and the compression displacement is increased for each rotation of the drive shaft. When the pressure control valve closes to disconnect the discharge chamber and the pressure regulation chamber, the pressure of the control pressure chamber becomes low and about the same as that of the swash plate chamber. This moves the non-rotation movable body and the movable body toward the rear. Thus, the inclination angle of the swash plate decreases, the piston stroke is shortened, and the compressor displacement is decreased for each rotation of the drive shaft.

Further, in each of these compressors, when the inclination angle of the swash plate changes, the link mechanism is configured so that the top dead center of the first head of each piston is shifted by a greater distance than the top dead center of the second head. More specifically, when the inclination angle of the swash plate is changed, the top dead center of the second head of each piston remains at substantially the same position but the top dead center of the first head is shifted over a relatively long distance to another position. Thus, as the inclination angle of the swash plate approaches zero degrees, each piston slightly performs compression with the second head and does not perform compression with the first head.

In each of these conventional compressors, the actuator is located at the second side of the swash plate, that is, the same side as the second cylinder bores as viewed from the swash plate. Thus, in these compressors, it is difficult to provide open space in the housing at the second side of the swash plate to allow for forward and rearward movement of the non-rotation movable body and the movable body. Further, since the size of the actuator is limited in the radial direction, displacement control is difficult. Moreover, when enlarging the housing in the radial direction so that the inclination angle of the swash plate is easily changed, it may become difficult to install the compressor in a vehicle or the like.

SUMMARY OF THE INVENTION

It is an object of the present invention to provide a compact compressor capable of performing superior displacement control.

One aspect of the present invention is a variable displacement swash plate compressor including a housing, a drive shaft, a swash plate, a link mechanism, a piston, a conversion mechanism, and actuator, and a control mechanism. The housing includes a suction chamber, a discharge chamber, a swash plate chamber, and a cylinder bore pair. The drive shaft is rotationally supported by the housing in a rotatable manner. The swash plate is rotatable together with the drive shaft in the swash plate chamber. The link mechanism is arranged between the drive shaft and the swash plate. The link mechanism allows for changes in an inclination angle of the swash plate relative to a direction orthogonal to a rotation axis of the drive shaft. The piston is reciprocally accommodated in the cylinder bore pair. The conversion mechanism is configured to reciprocate the piston in the cylinder bore pair with a stroke that is in accordance with the inclination angle of the swash plate when the swash plate rotates. The actuator is capable of changing the inclination angle of the swash plate. The control mechanism is configured to control the actuator. The cylinder bore pair includes a first cylinder bore, which is located at a first side of the swash plate, and a second cylinder bore, which is located at a second side of the swash plate. The piston includes a first head, which reciprocates in the first cylinder bore, and a second head, which is formed integrally with the first head and reciprocates in the second cylinder bore. The link mechanism is configured to shift a top dead center of the first head over a longer distance than a top dead center of the second head when the inclination angle of the swash plate changes. The actuator is located at the same side as the first cylinder bore as viewed from the swash plate, and the actuator is rotatable integrally with the drive shaft. The actuator includes a partitioning body, which is loosely fitted to the drive shaft in the swash plate chamber, a movable body, which is coupled to the swash plate and movable relative to the partitioning body along the rotation axis, and a control pressure chamber, which is defined by the partitioning body and the movable body. The pressure of the control pressure chamber moves the movable body. The control mechanism is configured to change the pressure of the control pressure chamber to move the movable body.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE EMBODIMENTS

First and second embodiments will now be described with reference to the drawings. Compressors of the first and second embodiments are each installed in a vehicle to form a refrigeration circuit of a vehicle air conditioner.

First Embodiment

Figure 1:
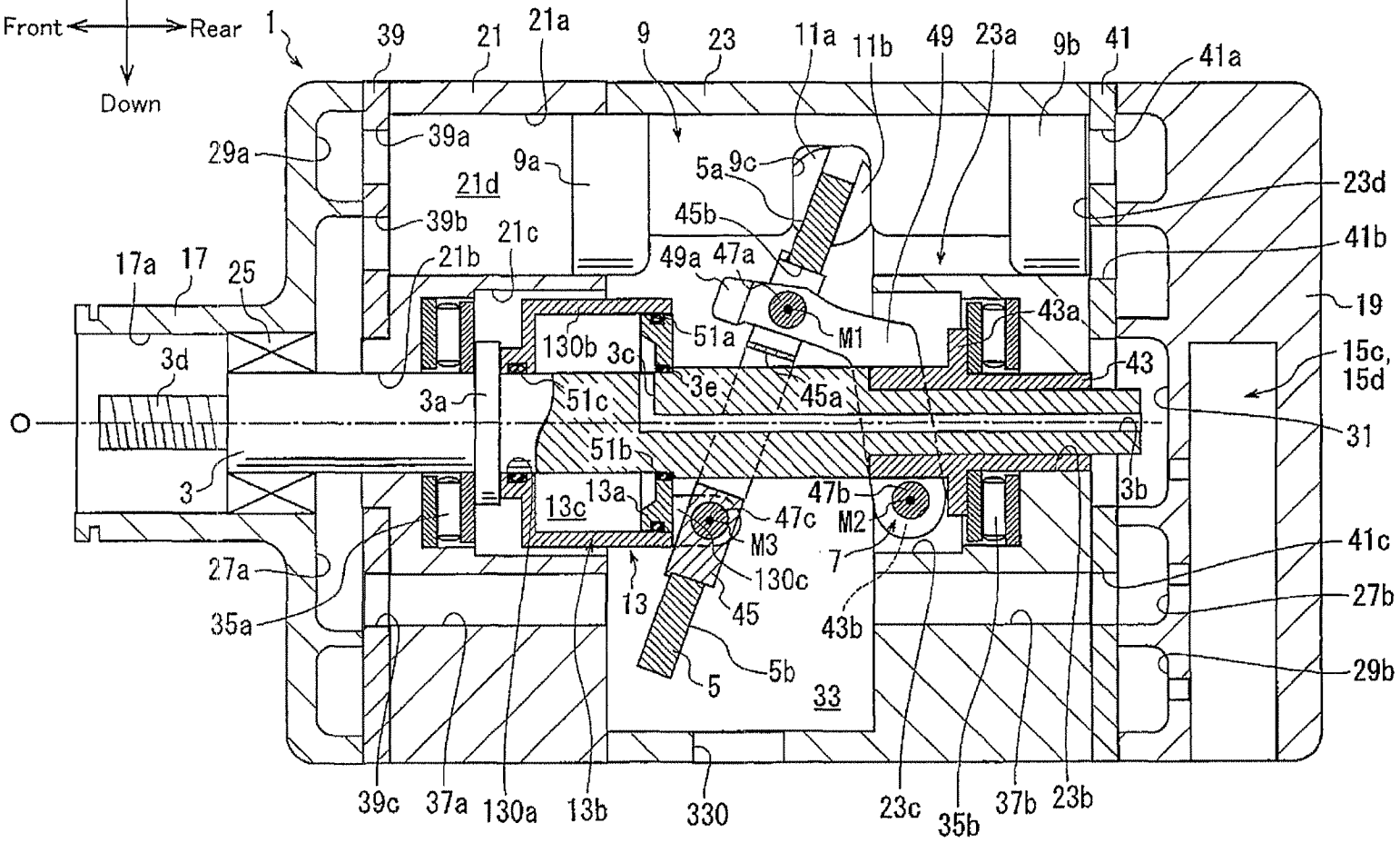
FIG. 1 is a cross-sectional view showing a compressor of a first embodiment when the displacement is maximal.
Figure 2:
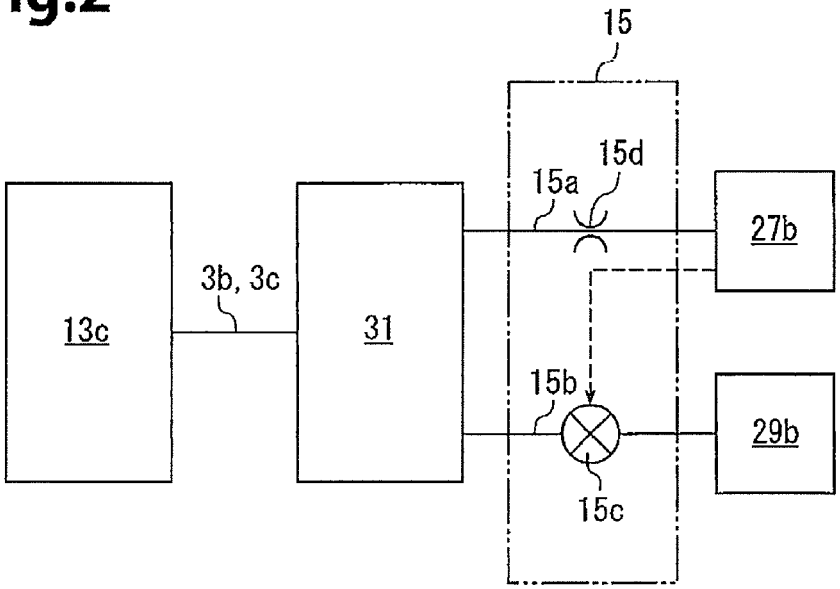
FIG. 2 is a schematic diagram showing a control mechanism in the compressor of FIG. 1.
Figure 3:
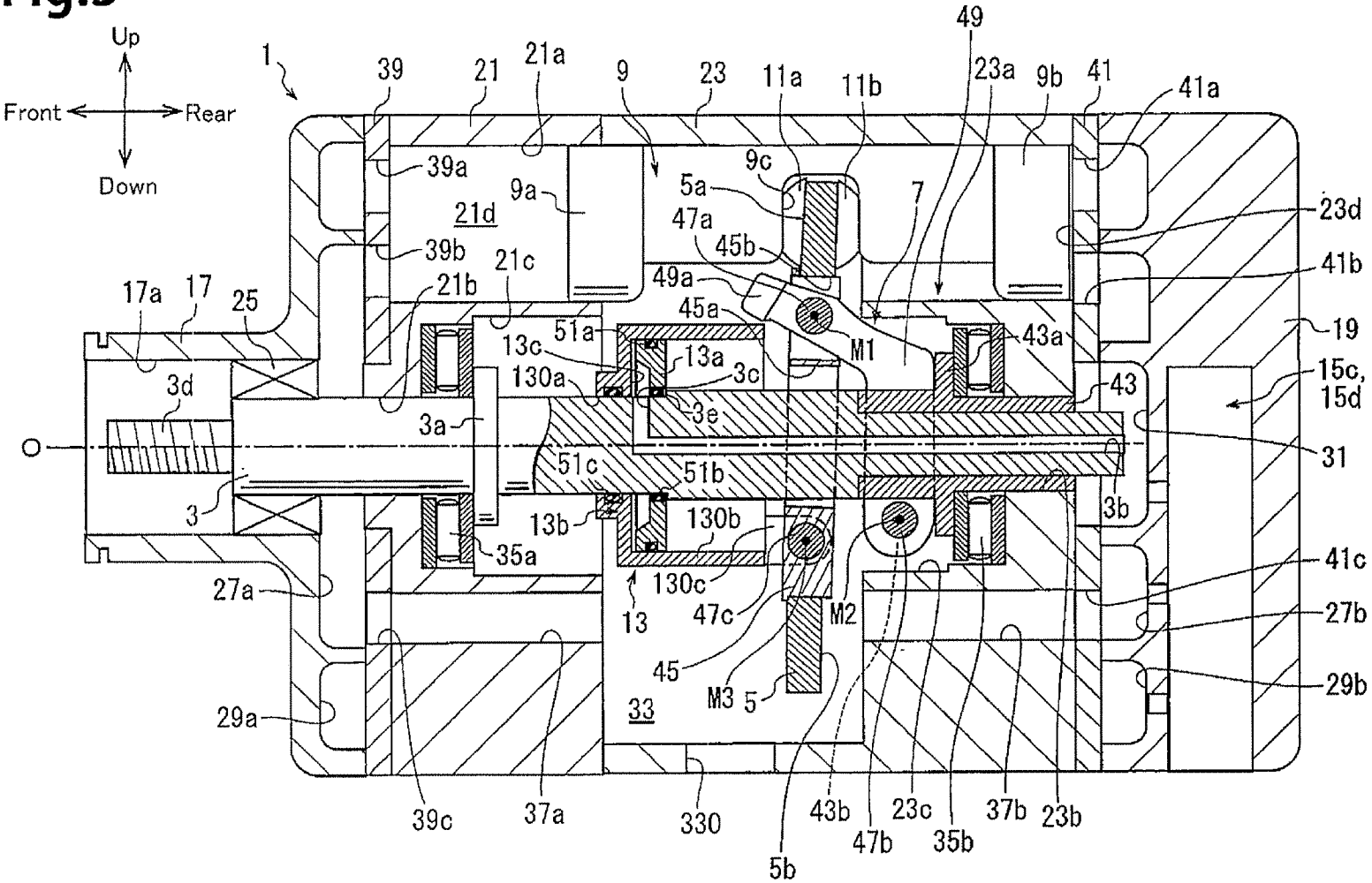
FIG. 3 is a cross-sectional view showing the compressor of FIG. 1 when the displacement is minimal.

Referring to FIGS. 1 and 3, a compressor of the first embodiment includes a housing 1, a drive shaft 3, a swash plate 5, a link mechanism 7, pistons 9, front and rear shoes 11*a* and 11*b*, an actuator 13, and a control mechanism 15, which is shown in FIG. 2. Each piston 9 is provided with a pair of the shoes 11*a* and 11*b*.

As shown in FIG. 1, the housing 1 includes a front housing member 17, which is located at the front of the compressor, a rear housing member 19, which is located at the rear of the compressor, and first and second cylinder blocks 21 and 23, which are located between the front housing member 17 and the rear housing member 19.

The front housing member 17 includes a boss 17*a*, which projects toward the front. A sealing device 25 is arranged in the boss 17*a* around the drive shaft 3. Further, the front housing member 17 includes a first suction chamber 27*a* and a first discharge chamber 29*a*. The first suction chamber 27*a* is located in a radially inner portion of the front housing member 17, and the first discharge chamber 29*a* is located in a radially outer portion of the front housing member 17.

The rear housing member 19 includes the control mechanism 15. The rear housing member 19 includes a second suction chamber 27*b*, a second discharge chamber 29*b*, and a pressure regulation chamber 31. The second suction chamber 27*b* is located in a radially inner portion of the rear housing member 19, and the second discharge chamber 29*b* is located in a radially outer portion of the rear housing member 19. The pressure regulation chamber 31 is located in a radially central portion of the rear housing member 19. A discharge passage (not shown) connects the first discharge chamber 29*a* and the second discharge chamber 29*b*. The discharge passage includes a discharge port, which is in communication with the outer side of the compressor.

A swash plate chamber 33 is defined in the first cylinder block 21 and the second cylinder block 23. The swash plate chamber 33 is located in a central portion of the housing 1.

The first cylinder block 21 includes first cylinder bores 21*a*, which are arranged at equal angular intervals in the circumferential direction and which extend parallel to one another. Each first cylinder bore 21*a* corresponds to a first cylinder bore of the present invention.

Further, the first cylinder block 21 includes a first shaft bore 21*b*. The drive shaft 3 extends through the first shaft bore 21*b*. The first cylinder block 21 also includes a first recess 21*c*, which is located at the rear side of the first shaft bore 21*b*. The first recess 21*c* is in communication with the first shaft bore 21*b* and coaxial with the first shaft bore 21*b*. Further, the first recess 21*c* is in communication with the swash plate chamber 33 and includes a stepped wall surface. A first thrust bearing 35*a* is arranged in a front portion of the first recess 21*c*. The first cylinder block 21 includes a first suction passage 37*a* that communicates the swash plate chamber 33 with the first suction chamber 27*a*.

In the same manner as the first cylinder block 21, the second cylinder block 23 includes second cylinder bores 23*a*. Each second cylinder bore 23*a* corresponds to a second cylinder bore of the present invention. Corresponding ones of the first cylinder bores 21*a* and the second cylinder bores 23*a* are coaxially aligned to form cylinder bore pairs.

Further, the second cylinder block 23 includes a second shaft bore 23*b*. The drive shaft 3 extends through the second shaft bore 23*b*. The second shaft bore 23*b* is in communication with the pressure regulation chamber 31. The second cylinder block 23 also includes a second recess 23*c*, which is located at the front side of the second shaft bore 23*b*. The second recess 23*c* is in communication with the second shaft bore 23*b* and coaxial with the second shaft bore 23*b*. Further, the second recess 23*c* is in communication with the swash plate chamber 33 and includes a stepped wall surface. A second thrust bearing 35*b* is arranged in a rear portion of the second recess 23*c*. The second cylinder block 23 includes a second suction passage 37*b* that communicates the swash plate chamber 33 with the second suction chamber 27*b*.

The swash plate chamber 33 is connected to an evaporator (not shown) via a suction port 330 formed in the second cylinder block 23.

A first valve plate 39 is arranged between the front housing member 17 and the first cylinder block 21. The first valve plate 39 includes a suction port 39*b* and a discharge port 39*a* for each first cylinder bore 21*a*. A suction valve mechanism (not shown) is provided for each suction port 39*b*. Each suction port 39*b* communicates the corresponding first cylinder bore 21*a* with the first suction chamber 27*a*. A discharge valve mechanism (not shown) is provided for each discharge port 39*a*. Each discharge port 39*a* communicates the corresponding first cylinder bore 21*a* with the first discharge chamber 29*a*. The first valve plate 39 also includes a communication hole 39*c*. The communication hole 39*c* communicates the first suction chamber 27*a* with the swash plate chamber 33 through the first suction passage 37*a*.

A second valve plate 41 is arranged between the rear housing member 19 and the second cylinder block 23. In the same manner as the first valve plate 39, the second valve plate 41 includes a suction port 41*b* and a discharge port 41*a* for each second cylinder bore 23*a*. A suction valve mechanism (not shown) is provided for each suction port 41*b*. Each suction port 41*b* communicates the corresponding second cylinder bore 23*a* with the second suction chamber 27*b*. A discharge valve mechanism (not shown) is provided for each discharge port 41*a*. Each discharge port 41*a* communicates the corresponding second cylinder bore 23*a* with the second discharge chamber 29*b*. The second valve plate 41 also includes a communication hole 41*c*. The communication hole 41*c* communicates the second suction chamber 27*b* with the swash plate chamber 33 through the second suction passage 37*b*.

The first and second suction chambers 27*a* and 27*b* and the swash plate chamber 33 are in communication with one another through the first and second suction passages 37*a* and 37*b*. Thus, the first and second suction chambers 27*a* and 27*b* and the swash plate chamber 33 have substantially the same pressure. More accurately, the pressure of the swash plate chamber 33 is slightly higher than the pressure of the first and second suction chambers 27*a* and 27*b* due to the effect of blow-by gas. Refrigerant gas from the evaporator flows into the swash plate chamber 33 through the suction port 330. Thus, the pressure of each of the swash plate chamber 33 and the first and second suction chambers 27*a* and 27*b* is lower than the pressure of each of the first and second discharge chambers 29*a* and 29*b*. In this manner, the swash plate chamber 33 and the first and second suction chambers 27*a* and 27*b* define a low pressure chamber.

The swash plate 5, the actuator 13, and a flange 3*a* are arranged on the drive shaft 3. The drive shaft 3 is inserted through the boss 17*a* toward the rear and inserted through the first and second shaft bores 21*b* and 23*b* in the first and second cylinder blocks 21 and 23. The front end of the drive shaft 3 is located in the boss 17*a*, and the rear end is located in the pressure regulation chamber 31. The first and second shaft bores 21*b* and 23*b* support the drive shaft 3 in the housing 1 so that the drive shaft 3 is rotatable the rotation axis O. The swash plate 5, the actuator 13, and the flange 3*a* are each located in the swash plate chamber 33. The flange 3*a* is located between the first thrust bearing 35*a* and the actuator 13, more specifically, between the first thrust bearing 35*a* and a movable body 13*b*. The flange 3*a* restricts contact of the first thrust bearing 35*a* and the movable body 13*b*. Radial bearings may be arranged between the drive shaft 3 and the walls of the first and second shaft bores 21*b* and 23*b*.

A support member 43 is fitted to the rear portion of the drive shaft 3. The support member 43 includes a flange 43*a*, which is in contact with the second thrust bearing 35*b*, and a coupling portion 43*b*, which receives a second pin 47*b*. The drive shaft 3 includes an axial passage 3*b* and a radial passage 3*c*. The axial passage 3*b* extends through the drive shaft along the rotation axis O toward the front from the rear end of the drive shaft 3. The radial passage 3*c* extends from the front end of the axial passage 3*b* in the radial direction and opens in the outer surface of the drive shaft 3. The axial passage 3*b* and the radial passage 3*c* define a communication passage. The rear end of the axial passage 3*b* is connected to the pressure regulation chamber 31, or the low pressure chamber. The radial passage 3*c* is connected to a control pressure chamber 13*c*. Further, the drive shaft 3 includes a step 3*e*.

The swash plate 5 is an annular plate and includes a front surface 5*a* and a rear surface 5*b*. The front surface 5*a* of the swash plate 5 faces the front side of the compressor in the swash plate chamber 33. The rear surface 5*b* of the swash plate 5 faces the rear side of the compressor in the swash plate chamber 33. The front surface 5*a* and the rear surface 5*b* of the swash plate 5 respectively correspond to a first surface and a second surface of the present invention. In the compressor, the first cylinder bores 21*a* are each located at the same side as the front surface 5*a* of the swash plate 5, that is, the front side (first side). The second cylinder bores 23*a* are each located at the same side as the rear surface 5*b* of the swash plate 5, that is, the rear side (second side).

The swash plate 5 is fixed to a ring plate 45. The ring plate 45 is an annular plate. An insertion hole 45*a* extends through the center of the ring plate 45. The drive shaft 3 is inserted through the insertion hole 45*a* to couple the swash plate 5 to the drive shaft 3. This arranges the swash plate 5 in the swash plate chamber 33 at the same side as the second cylinder bores 23*a*, that is, at a position located toward the rear in the swash plate chamber 33.

The link mechanism 7 includes a lug arm 49. The lug arm 49 is arranged at the rear side of the swash plate 5 in the swash plate chamber 33 and located between the swash plate 5 and the support member 43. The lug arm 49 is generally L-shaped. The lug arm 49 contacts the flange 43*a* of the support member 43 when the swash plate 5 is inclined relative to a direction orthogonal to the rotation shaft O at the minimum angle. In the compressor, the lug arm 49 allows the swash plate 5 to be maintained at the minimum inclination angle. The distal end of the lug arm 49 includes a weight 49*a*. The weight 49*a* extends over one half of the circumference of the actuator 13. The weight 49*a* may be designed to have a suitable shape.

A first pin 47*a* couples the distal end of the lug arm 49 to a top region of the ring plate 45. Thus, the distal end of the lug arm 49 is supported by the ring plate 45, or the swash plate 5, so that the lug arm 49 is pivotal about the axis of the first pin 47*a*, namely, a first pivot axis M1. The first pivot axis M1 extends in a direction perpendicular to the rotation axis O of the drive shaft 3.

A second pin 47*b* couples a basal end of the lug arm 49 to the support member 43. Thus, the basal end of the lug arm 49 is supported by the support member 43, or the drive shaft 3, so that the lug arm 49 is pivotal about the axis of the second pin 47*b*, namely, a second pivot axis M2. The second pivot axis M2 extends parallel to the first pivot axis M1. The lug arm 49 and the first and second pins 47*a* and 47*b* correspond to the link mechanism 7 of the present invention.

In the compressor, the link mechanism 7 couples the swash plate 5 and the drive shaft 3 so that the swash plate 5 rotates together with the drive shaft 3. As described above, the lug arm 49 is located between the swash plate 5 and the support member 43. Thus, the link mechanism 7 is located in the swash plate chamber 33 at the rear side of the swash plate 5, that is, the same side as the second cylinder bores 23*a* as viewed from the swash plate 5. The two ends of the lug arm 49 are respectively pivotal about the first pivot axis M1 and the second pivot axis M2 so that inclination angle of the swash plate 5 is changed, as shown in FIGS. 1 and 3.

The weight 49*a* extends along the distal end of the lug arm 49, that is, the side opposite to the second pivot axis M2 as viewed from the first pivot axis M1. The lug arm 49 is supported by the first pin 47*a* on the ring plate 45 so that the weight 49*a* is inserted through a groove 45*b* in the ring plate 45 and is located at the front side of the ring plate 45, that is, the front side of the swash plate 5. Rotation of the swash plate 5 around the rotation axis O generates centrifugal force that acts on the weight 49*a* at the front side of the swash plate 5.

Each piston 9 includes a front end that defines a first piston head 9*a* and a rear end that defines a second piston head 9*b*. The first piston head 9*a* corresponds to a first head of the present invention, and the second piston head 9*b* corresponds to a second head of the present invention.

The first piston head 9*a* is reciprocally accommodated in the corresponding first cylinder bore 21*a* defining a first compression chamber 21*d*. The second piston head 9*b* is reciprocally accommodated in the corresponding second cylinder bore 23*a* defining a second compression chamber 23*d*. Each piston 9 includes a recess 9*c*, which accommodates the semispherical shoes 11*a* and 11*b*. The shoes 11*a* and 11*b* convert the rotation of the swash plate 5 to the reciprocation of the piston 9. The shoes 11*a* and 11*b* correspond to a conversion mechanism of the present invention. In this manner, the first and second piston heads 9*a* and 9*b* are reciprocal in the first and second cylinder bores 21*a* and 23*a* with a stroke that is in accordance with the inclination angle of the swash plate 5.

The actuator 13 is located in front of the swash plate 5 in the swash plate chamber 33 and is movable into the first recess 21*c*. The actuator 13 includes a partitioning body 13*a* and a movable body 13*b*.

The partitioning body 13*a* is disk-shaped and loosely fitted to the drive shaft 3 in the swash plate chamber 33. An O-ring 51*a* is arranged on the outer circumferential surface of the partitioning body 13*a*, and an O-ring 51*b* is arranged on the inner circumferential surface of the partitioning body 13*a*.

The movable body 13*b* is tubular and has a closed end. Further, the movable body 13*b* includes an insertion hole 130*a*, through which the drive shaft 3 is inserted, a main body portion 130*b*, which extends from the front of the movable body 13*b* toward the rear, and a coupling portion 130*c*, which is formed on the rear end of the main body portion 130*b*. An O-ring 51*c* is arranged in the insertion hole 130*a*. The movable body 13*b* is located between the first thrust bearing 35*a* and the swash plate 5.

The drive shaft 3 is inserted into the main body portion 130*b* of the movable body 13*b* and through the insertion hole 130*a*. The partitioning body 13*a* is arranged in a movable manner in the main body portion 130*b*. The movable body 13*b* is rotatable together with the drive shaft 3 and movable along the rotation axis O of the drive shaft 3 at the front side of the swash plate 5 in the swash plate chamber 33. In this manner, the drive shaft 3 is inserted through the actuator 13, and the actuator 13 is rotatable integrally with the drive shaft 3 about the rotation axis O.

The movable body 13*b* and the link mechanism 7 are located at opposite sides of the swash plate 5 in the swash plate chamber 33. More specifically, the actuator 13, which includes the movable body 13*b*, is located in the swash plate chamber 33 at the front side of the swash plate 5, that is, the same side as the first cylinder bores 21*a* as viewed from the swash plate 5.

A third pin 47*c* couples a bottom region of the ring plate 45 to the coupling portion 130*c* of the movable body 13*b*. Thus, the ring plate 45, or the swash plate 5, is supported by the movable body 13*b* so as to be pivotal about the axis of the third pin 47*c*, namely, an action axis M3. The action axis M3 extends parallel to the first and second pivot axes M1 and M2. In this manner, the movable body 13*b* is coupled to the swash plate 5. The movable body 13*b* contacts the flange 3*a* when the swash plate 5 is inclined at the maximum angle. In the compressor, the movable body 13*b* allows the swash plate 5 to be maintained at the maximum inclination angle.

The control pressure chamber 13*c* is defined between the partitioning body 13*a* and the movable body 13*b*. The radial passage 3*c* extends into the control pressure chamber 13*c*. The control pressure chamber 13*c* is in communication with the pressure regulation chamber 31 through the radial passage 3*c* and the axial passage 3*b*.

As shown in FIG. 2, the control mechanism 15 includes a bleed passage 15*a*, a gas supplying passage 15*b*, a control valve 15*c*, and an orifice 15*d*. The bleed passage 15*a* and the gas supplying passage 15*b* form a control passage.

The bleed passage 15*a* is connected to the pressure regulation chamber 31 and the second suction chamber 27*b*. The pressure regulation chamber 31 is in communication with the control pressure chamber 13*c* through the axial passage 3*b* and the radial passage 3*c*. Thus, the control pressure chamber 13*c* and the second suction chamber 27*b* are in communication with each other through the bleed passage 15*a*. The bleed passage 15*a* includes the orifice 15*d*.

The gas supplying passage 15*b* is connected to the pressure regulation chamber 31 and the second discharge chamber 29*b*. Thus, in the same manner as the bleed passage 15*a*, the control pressure chamber 13*c* and the second discharge chamber 29*b* are in communication with each other through the axial passage 3*b* and the radial passage 3*c*. In this manner, the axial passage 3*b* and the radial passage 3*c* form portions of the bleed passage 15*a* and the gas supplying passage 15*b*, which serve as the control passage.

The control valve 15*c* is arranged in the gas supplying passage 15*b*. The control valve 15*c* adjusts the open degree of the gas supplying passage 15*b* based on the pressure of the second suction chamber 27*b*. A known valve may be used as the control valve 15*c*.

The distal end of the drive shaft 3 includes a threaded portion 3*d*. The threaded portion 3*d* couples the drive shaft 3 to a pulley or an electromagnetic clutch (neither shown). A belt (not shown), which is driven by a vehicle engine, runs along the pulley or a pulley of the electromagnetic clutch.

A pipe leading to the evaporator is connected to the suction port 330. A pipe leading to a condenser is connected to a discharge port (none shown). The compressor, the evaporator, an expansion valve, the condenser, and the like form the refrigeration circuit of the vehicle air conditioner.

In the compressor, the rotation of the drive shaft 3 rotates the swash plate 5 and reciprocates each piston 9 in the corresponding first and second cylinder bores 21*a* and 23*a*. Thus, the volumes of the first and second compression chambers 21*d* and 23*d* change in accordance with the piston stroke. This draws refrigerant gas into the swash plate chamber 33 through the suction port 330 from the evaporator. The refrigerant gas flows through the first and second suction chambers 27*a* and 27*b* and is compressed in the first and second compression chambers 21*d* and 23*d*, which then discharge the refrigerant gas into the first and second discharge chambers 29*a* and 29*b*. The refrigerant gas in the first and second discharge chambers 29*a* and 29*b* is discharged out of the discharge port and sent to the condenser.

During operation of the compressor, centrifugal force, which acts to decrease the inclination angle of the swash plate, and compression reaction, which acts to decrease the inclination angle of the swash plate 5 through the pistons 9, are applied to the rotation members, which include the swash plate 5, the ring plate 45, the lug arm 49, and the first pin 47*a*. The compressor displacement may be controlled by changing the inclination angle of the swash plate 5 thereby lengthening or shortening the stroke of the pistons 9.

More specifically, in the control mechanism 15, when the control valve 15*c* shown in FIG. 2 decreases the open degree of the gas supplying passage 15*b*, the pressure of the control pressure chamber 13*c* becomes substantially equal to the pressure of the second suction chamber 27*b*. Thus, the centrifugal force and the compression reaction acting on the rotation members move the movable body 13*b* toward the rear. This contracts the control pressure chamber 13*c* and decreases the inclination angle of the swash plate 5.

As a result, referring to FIG. 3, the swash plate 5 pivots about the action axis M3 of the swash plate 5 and the two ends of the lug arm 49 respectively pivot about the first and second pivot axes M1 and M2 so that the lug arm 49 moves toward the flange 43*a* of the support member 43. This shortens the stroke of the pistons 9 and decreases the compressor displacement for each rotation of the drive shaft 3. The inclination angle of the swash plate 5 in FIG. 3 is the minimum inclination angle of the compressor.

In the compressor, the centrifugal force acting on the weight 49*a* is applied to the swash plate 5. Thus, in the compressor, the swash plate 5 easily moves in the direction that decreases the inclination angle of the swash plate 5. Further, when the movable body 13*b* moves toward the rear along the rotation axis O of the drive shaft 3, the rear end of the movable body 13*b* is arranged at the inner side of the weight 49*a*. As a result, in the compressor, when the inclination angle of the swash plate 5 decreases, the weight 49*a* covers about one half of the rear end of the movable body 13*b*.

When the control valve 15*c* shown in FIG. 2 increases the open degree of the gas supplying passage 15*b*, the pressure of the control pressure chamber 13*c* becomes substantially equal to the pressure of the second discharge chamber 29*b*. Thus, the movable body 13*b* of the actuator 13 moves toward the front against the centrifugal force and the compression reaction acting on the rotation members. This enlarges the control pressure chamber 13*c* and increases the inclination angle of the swash plate 5.

As a result, referring to FIG. 1, the swash plate 5 pivots in the opposite direction about the action axis M3 of the swash plate 5 and the two ends of the lug arm 49 respectively pivot in the opposite direction about the first and second pivot axes M1 and M2 so that the lug arm 49 moves away from the flange 43*a* of the support member 43. This lengthens the stroke of the pistons 9 and increases the compressor displacement for each rotation of the drive shaft 3. The inclination angle of the swash plate 5 in FIG. 1 is the maximum inclination angle of the compressor.

In the compressor, the link mechanism 7 couples the swash plate 5 and the drive shaft 3 so that the swash plate 5 is located near the second cylinder bores 23*a* in the swash plate chamber 33. Thus, in the compressor, when the inclination angle of the swash plate 5 is maximal and the stroke of the pistons 9 is maximal, the top dead center of each first piston head 9*a* is located closest to the first valve plate 39, and the top dead center of each second piston head 9*b* is located closest to the second valve plate 41. As the inclination angle of the swash plate 5 decreases and shortens the stroke of the pistons 9, the top dead center of each first piston head 9*a* is gradually separated from the first valve plate 39. However, the top dead center of each second piston head 9*b* remains at substantially the same position as when the stroke of the pistons 9 is maximal and is kept close to the second valve plate 41.

In this manner, in the compressor, when the inclination angle of the swash plate 5 is changed, the top dead center of the second piston head 9*b* of each piston 9 remains at substantially the same position but the top dead center of the first piston head 9*a* of each piston 9 is shifted over a relatively long distance to another position. In the compressor, a relatively large open space is provided in the swash plate chamber 33 near the first cylinder bores 21*a*. Further, the actuator 13 is located near the first cylinder bores 21*a* in the swash plate chamber 33. Accordingly, the compressor allows the actuator 13 to be enlarged in the radial direction without the need to enlarge the housing 1 in the radial direction. This allows the control pressure chamber 13*c* to be large. Thus, in the compressor, the movable body 13*b* is moved in a preferred manner by a change in the pressure of the control pressure chamber 13*c*.

In the compressor, the partitioning body 13*a* is loosely fitted to the drive shaft 3, and the movable body 13*b* easily moves relative to the partitioning body 13*a*. Thus, in the compressor, the movable body 13*b* is moved in a preferred manner along the rotation axis O.

In the compressor, the link mechanism 7 is located at the same side as the second cylinder bores 23*a* as viewed from the swash plate 5. In other words, the link mechanism 7 and the movable body 13*b* are located at opposite sides of the swash plate 5. As described above, when the inclination angle of the swash plate 5 is changed, the top dead center of the second piston head 9*b* of each piston 9 remains at substantially the same position. Thus, the open space that is provided in the swash plate chamber 33 is relatively narrow near the second cylinder bores 23*a*. However, the link mechanism 7 of the compressor is only used to change the inclination angle of the swash plate 5. Further, the lug arm 49 is L-shaped so that the lug arm 49 is reduced in size while obtaining a sufficient pivoting range. Accordingly, even if the link mechanism 7 is arranged in the swash plate chamber 33 near the second cylinder bores 23*a* where open space is limited, the link mechanism 7 sufficiently functions.

Further, in the compressor, the link mechanism 7 is located at the same side as the second cylinder bores 23*a* as viewed from the swash plate 5. This increases the open space near the first cylinder bores 21*a* in the swash plate chamber 33.

Accordingly, the compressor of the first embodiment is compact, easy to install in a vehicle, and allows for superior displacement control.

In the control mechanism 15 of the compressor, the control pressure chamber 13*c* and the second suction chamber 27*b* are in communication through the bleed passage 15*a*, and the control pressure chamber 13*c* and the second discharge chamber 29*b* are in communication through the gas supplying passage 15*b*. Further, the control valve 15*c* allows for adjustment of the open degree of the gas supplying passage 15*b*. Accordingly, in the compressor, the high pressure of the second discharge chamber 29*b* readily increases the pressure of the control pressure chamber 13*c* to a high value so that the compressor displacement is readily increased.

Further, in the compressor, the swash plate chamber 33 is used as a refrigerant gas passage leading to the first and second suction chambers 27*a* and 27*b*. This has a muffler effect that reduces suction pulsation of the refrigerant gas and decreases noise of the compressor.

Second Embodiment

Figure 4:
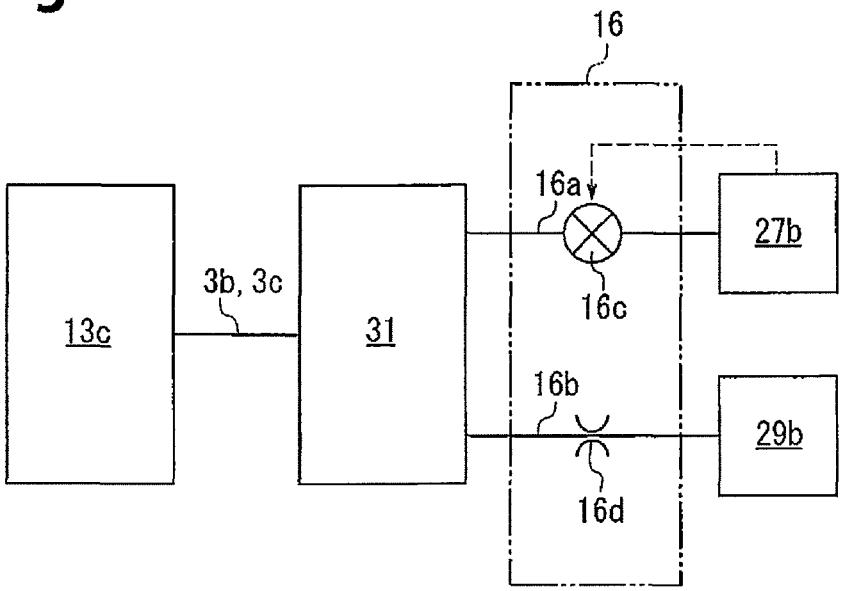
FIG. 4 is a schematic diagram showing a control mechanism in a compressor of a second embodiment.

A compressor of the second embodiment includes a control mechanism 16 shown in FIG. 4 in lieu of the control mechanism 15 used in the compressor of the first embodiment. The control mechanism 16 includes a bleed passage 16*a*, a gas supplying passage 16*b*, a control valve 16*c*, and an orifice 16*d*. The bleed passage 16*a* and the gas supplying passage 16*b* form a control passage.

The bleed passage 16*a* is connected to the pressure regulation chamber 31 and the second suction chamber 27*b*. Thus, the control pressure chamber 13*c* and the second suction chamber 27*b* are in communication with each other through the bleed passage 16*a*. The gas supplying passage 16*b* is connected to the pressure regulation chamber 31 and the second discharge chamber 29*b*. Thus, the control pressure chamber 13*c* and the pressure regulation chamber 31 are in communication with the second discharge chamber 29*b* through the gas supplying passage 16*b*. The gas supplying passage 16*b* includes the orifice 16*d*.

The control valve 16*c* is arranged in the bleed passage 16*a*. The control valve 16*c* adjusts the open degree of the bleed passage 16*a* based on the pressure of the second suction chamber 27*b*. In the same manner as the control valve 15*c*, a known valve may be used as the control valve 16*c*. Further, the axial passage 3*b* and the radial passage 3*c* form portions of the bleed passage 16*a* and the gas supplying passage 16*b*. Other portions of the compressor have the same structure as the compressor of the first embodiment. Same reference numerals are given to those components that are the same as the corresponding components of the first embodiment. Such components will not be described in detail.

In the control mechanism 16 of the compressor, when the control valve 16*c* decreases the open degree of the bleed passage 16*a*, the pressure of the control pressure chamber 13*c* becomes substantially equal to the pressure of the second discharge chamber 29*b*. Thus, the centrifugal force and the compression reaction acting on the rotation members move the movable body 13*b* of the actuator 13 toward the front. This expands the control pressure chamber 13*c* and increases the inclination angle of the swash plate 5.

As a result, in the same manner as the compressor of the first embodiment, the inclination angle of the swash plate 5 increases in the compressor and lengthens the stroke of the pistons 9. This increases the compressor displacement for each rotation of the drive shaft 3 (refer to FIG. 1).

When the control valve 16*c* increases the open degree of the bleed passage 16*a*, the pressure of the control pressure chamber 13*c* becomes substantially equal to the pressure of the second suction chamber 27*b*. Thus, the centrifugal force and the compression reaction acting on the rotation members move the movable body 13*b* toward the rear. This contracts the control pressure chamber 13*c* and decreases the inclination angle of the swash plate 5.

As a result, the inclination angle of the swash plate 5 decreases in the compressor and shortens the stroke of the pistons 9. This decreases the compressor displacement for each rotation of the drive shaft 3 (refer to FIG. 3).

In the control mechanism 16 of the compressor, the control valve 16*c* allows for adjustment of the open degree of the bleed passage 16*a*. Thus, in the compressor, the low pressure of the second suction chamber 27*b* gradually decreases the pressure of the control pressure chamber 13*c* to a low value so that a suitable driving feel of the vehicle is maintained. Otherwise, the operation of the compressor is the same as the compressor of the first embodiment.

The present invention is not restricted to the first and second embodiments described above. It should be apparent to those skilled in the art that the present invention may be embodied in many other specific forms without departing from the spirit or scope of the invention. Particularly, it should be understood that the present invention may be embodied in the following forms.

In the compressors of the first and second embodiments, refrigerant gas is drawn into the first and second suction chambers 27*a* and 27*b* through the swash plate chamber 33. Instead, refrigerant gas may be directly drawn into the first and second suction chambers 27*a* and 27*b* from a pipe through a suction port. In this case, the first and second suction chambers 27*a* and 27*b* may be configured to communicate with the swash plate chamber 33 in the compressor, and the swash plate chamber 33 is configured to serve as a low pressure chamber.

The pressure regulation chamber 31 may be omitted from the compressors of the first and second embodiments.

The present examples and embodiments are to be considered as illustrative and not restrictive, and the invention is not to be limited to the details given herein, but may be modified within the scope and equivalence of the appended claims.

What is claimed is:

1. A variable displacement swash plate compressor comprising:

a housing including a suction chamber, a discharge chamber, a swash plate chamber, and a cylinder bore pair including a first cylinder bore and a second cylinder bore;

a drive shaft rotationally supported by the housing;

a swash plate that is rotatable together with the drive shaft in the swash plate chamber;

a link arranged between the drive shaft and the swash plate, wherein the link allows for changes in an inclination angle of the swash plate relative to a direction orthogonal to a rotation axis of the drive shaft;

a piston reciprocally accommodated in each of the first cylinder bore and the second cylinder bore;

a converter that is configured to reciprocate the piston in the cylinder bore pair with a stroke that is in accordance with the inclination angle of the swash plate when the swash plate rotates;

an actuator capable of changing the inclination angle of the swash plate; and a controller that is configured to control the actuator; wherein the first cylinder bore is located at a first side of the swash plate, and the second cylinder bore is located at a second side of the swash plate;

the piston includes a first head, which reciprocates in the first cylinder bore, and a second head, which is integral with the first head and reciprocates in the second cylinder bore;

the link is configured to shift a top dead center of the first head over a longer distance than a top dead center of the second head when the inclination angle of the swash plate changes;

the actuator is rotatable integrally with the drive shaft;

the actuator includes a partitioning body, which is loosely fitted to the drive shaft in the swash plate chamber, a movable body, which is coupled to the swash plate and movable relative to the partitioning body along the rotation axis, and a control pressure chamber, which is defined by the partitioning body and the movable body, wherein pressure of the control pressure chamber moves the movable body;

the controller is configured to change the pressure of the control pressure chamber to move the movable body; and the partitioning body, the movable body, and the control pressure chamber are located at the first side of the swash plate.

2. The variable displacement swash plate compressor according to claim 1, wherein the link is located at the second side of the swash plate.

3. The variable displacement swash plate compressor according to claim 1, wherein the controller includes a bleed passage, a gas supplying passage, and a control valve that are each in fluid communication with the control pressure chamber.

* * * * *